US007380575B2

(12) United States Patent
Stricklin

(10) Patent No.: US 7,380,575 B2
(45) Date of Patent: Jun. 3, 2008

(54) FILLER DEVICE FOR FILLING FLEXIBLE BAGS

(75) Inventor: Douglas K. Stricklin, Brea, CA (US)

(73) Assignee: Scholle Corporation, Irvine, CA (US)

( * ) Notice: Subject to any disclaimer, the term of this patent is extended or adjusted under 35 U.S.C. 154(b) by 18 days.

(21) Appl. No.: 11/312,157

(22) Filed: Dec. 20, 2005

(65) Prior Publication Data

US 2007/0137727 A1 Jun. 21, 2007

(51) Int. Cl.
*B65B 43/42* (2006.01)

(52) U.S. Cl. ..... 141/166; 141/10; 141/73; 141/114; 141/314; 53/469

(58) Field of Classification Search ..... 141/10, 141/59, 65, 69, 71, 73, 114, 166, 314, 315, 141/316; 53/405, 408, 469
See application file for complete search history.

(56) References Cited

U.S. PATENT DOCUMENTS 2,831,510 A * 4/1958 Carter ..... 141/59
4,120,134 A * 10/1978 Scholle ..... 53/434
4,386,636 A * 6/1983 Ellert ..... 141/10
4,962,797 A * 10/1990 Thomsen ..... 141/10
5,771,665 A * 6/1998 Nelson et al. ..... 53/459
6,148,874 A * 11/2000 Rutter et al. ..... 141/10
6,330,780 B1 * 12/2001 Shipway ..... 53/426

* cited by examiner

*Primary Examiner*—Timothy L. Maust
(74) *Attorney, Agent, or Firm*—The Watson Intellectual Property Group, PLC; Jovan N. Jovanovic; Vladan M. Vasiljevic

(57) ABSTRACT

A filler device for filling flexible bags including a table, a container gripper assembly, a fill valve and a evacuation facilitating assembly. The table has a top surface configured for receipt of a flexible bag. The container gripper assembly is configured for receipt of a spout of a flexible bag positioned on the table. The fill valve is positionable in fluid communication with the flexible bag. The evacuation facilitating assembly comprises a frame, a leg member and displacing assembly. The frame is spaced apart from the table. The leg member is associated with the frame. The displacing assembly displaces the leg member relative to the frame to, in turn, direct the leg member between a first position wherein the leg member is spaced apart from the table to a second position wherein the flexible bag is sandwiched between the leg member and the table.

16 Claims, 4 Drawing Sheets

FILLER DEVICE FOR FILLING FLEXIBLE BAGS

BACKGROUND OF THE INVENTION

1. Field of the Invention

The invention relates in general to filler devices, and more particularly to a filler device for filling flexible bags wherein the filler device further includes a system for minimizing/evacuating air that would otherwise become trapped within the filled container.

2. Background Art

One inevitable consequence of filling flexible bags is that a residual quantity of air remains trapped in the flexible container when filled. This can be detrimental as the air that remains can be contaminated, or, it may have an undesirable effect on the flowable material contained within the flexible bag.

One method by which to preclude this air from entering or remaining the flexible bag after filling is to utilize a pad positioned below the table which can be raised selectively so as to force the underside of the flexible bag against the bottom of the spout before and after filling. While this solution minimizes the quantity of air that enters into the flexible bag, such mechanisms are relatively complicated. Moreover, these devices must be positioned below the table, thereby limiting the use of different table structures (such as bomb-bay tables and the like).

Another solution comprises the tilting of the table upon which the flexible bag is positioned. Such a solution likewise limits the entry of air into the flexible bag after filling. However, this solution may be disruptive to the flexible container. Moreover, the use of a tilting table is relatively complicated and is likewise difficult to implement in a number of filler device applications.

Thus, it is an object of the present invention to minimize air that inadvertently enters a flexible bag during filling thereof.

It is another object of the present invention to provide for a filler device which effectively limits the introduction of air during the filling of a flexible bag.

It is another object of the present invention to provide for a filler device that effectively limits the introduction of air during the filling of a flexible bag while facilitating the use of a number of differently configured tables.

These objects as well as other objects of the present invention will become apparent in light of the present specification, claims, and drawings.

SUMMARY OF THE INVENTION

The invention comprises a filler device for filling flexible bags. The invention includes a table, a container gripper assembly, a fill valve and a evacuation facilitating assembly. The table has a top surface configured for receipt of a flexible bag. The container gripper assembly is configured for receipt of a spout of a flexible bag positioned on the table. The fill valve is positionable in fluid communication with the flexible bag. The evacuation facilitating assembly comprises a frame, a leg member and displacing means. The frame is spaced apart from the table. The leg member is associated with the frame. The displacing means displaces the leg member relative to the frame to, in turn, direct the leg member between a first position wherein the leg member is spaced apart from the table to a second position wherein the flexible bag is sandwiched between the leg member and the table.

In a preferred embodiment, the leg member comprises a stem and a plate. The stem has a first end and a second end. The first end is associated with the frame. The plate is associated with the second end of the stem.

In one such preferred embodiment, the plate includes an inner surface and an outer surface and an outer periphery and wherein the outer surface is outwardly convex. In one such embodiment, the outer periphery comprises a substantially circular geometric configuration.

In a preferred embodiment, the displacing means comprises an air cylinder. In other embodiments, the displacing means comprises one of the group consisting of: air cylinder, mechanically coupled assembly and servo motors.

In another preferred embodiment, the filler device further comprises means for adjusting the movement of the leg member relative to the frame.

In another preferred embodiment, the adjusting means comprises a threadform and a fastener. The threadform is positioned on the second end of the stem of the leg member. The fastener has a mating threadform coupled to the plate. Rotative movement of the fastener translates the fastener, and in turn, the plate along the threadform of the stem.

In a preferred embodiment, the frame member is positioned above the upper surface of the table.

In another preferred embodiment, the table comprises a bomb-bay table.

In another preferred embodiment, the leg member is spaced apart from the container gripper assembly and the fill valve.

In another aspect of the invention, the invention comprises a method of displacing air within a flexible bag upon filling thereof with a flowable material. The method comprises the steps of: positioning a flexible bag on a table; filling the container with a flowable material; forcing a leg member toward the table and into the flexible bag so as to reduce the volume of the flexible bag thereby removing air remaining in the filled flexible bag.

In one preferred embodiment, the method further comprises the step of adjusting the travel of the leg member to control the reduction of the volume of the flexible bag.

In another preferred embodiment, the leg member is positioned above the table.

In yet another preferred embodiment, the method further comprises the steps of: grasping the spout; and removing a cap from the spout prior to the step of filling.

In another aspect of the invention, the invention comprises a filler device for filling flexible bags comprising a table, a container gripper assembly, a cap a fill valve and a evacuation facilitating assembly. The table has a top surface configured for receipt of a flexible bag. The container gripper assembly is configured for receipt of a pout of a flexible bag positioned on the table. The cap handling assembly is positioned proximate the container gripper assembly. The fill valve is positionable in fluid communication with the flexible bag. The evacuation facilitating assembly comprises a frame, a leg member and displacing means. The frame is positioned above the table. The leg member is movably coupled to the frame. The displacing means displaces the leg member relative to the frame to, in turn, direct the leg member between a first position wherein the leg member is spaced apart from the table to a second position wherein the flexible bag is sandwiched between the leg member and the table.

In a preferred embodiment, the filler device further comprises means for adjusting the displacing means.

In yet another aspect of the invention, the invention comprises evacuation facilitating assembly for use in association with a filler device. The assembly comprises a frame, a leg member and displacing means. The frame is positioned above a table of a filler device. The leg member is movably coupled to the frame. The displacing means displace the leg member relative to the frame to, in turn, the direct the leg member between a first position wherein the leg member is spaced apart from a table to a second position wherein the flexible bag is sandwiched between the leg member and a table.

In a preferred embodiment, the assembly further comprises means for adjusting the displacing means.

In another preferred embodiment, the displacing means comprises an air cylinder.

BRIEF DESCRIPTION OF THE DRAWINGS

The invention will now be described with reference to the drawings wherein.

DETAILED DESCRIPTION OF THE DRAWINGS

Figure 1:
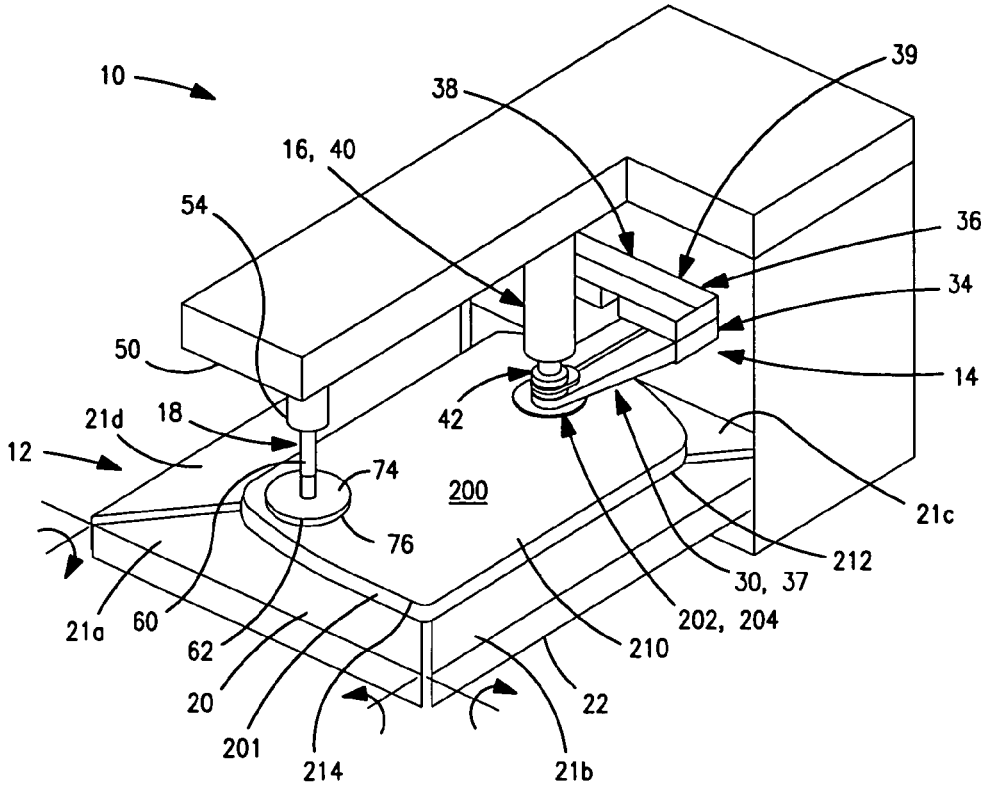
FIG. 1 of the drawings comprises a perspective view of a flexible container filled by a filler device of the present invention.

While this invention is susceptible of embodiment in many different forms, there is shown in the drawings and described herein in detail a specific embodiment with the understanding that the present disclosure is to be considered as an exemplification of the principles of the invention and is not intended to limit the invention to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the filler device for filling flexible bags is shown generally at 10. The filler device is configured for filling a number of differently sized flexible bags. One such exemplary bag is shown at 200. Flexible bag 200 includes body 201, spout 202 and cap 204. Flexible bag body 201 includes top panel 210, bottom panel 212 and joining seams, such as joining seam 214. It will be understood that while a conventional pillow-type container is shown, the invention is not limited to a flexible bag having such a configuration. Indeed, a number of different containers are contemplated for filling of the filler device.

Figure 3A:
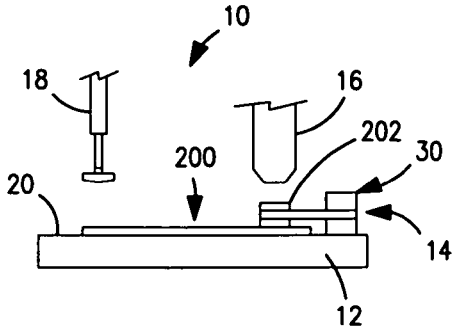
FIGS. 3*a-f* of the drawings comprises a schematic side elevational view of a flexible container undertaking the filling method of the present invention.
Figure 3B:
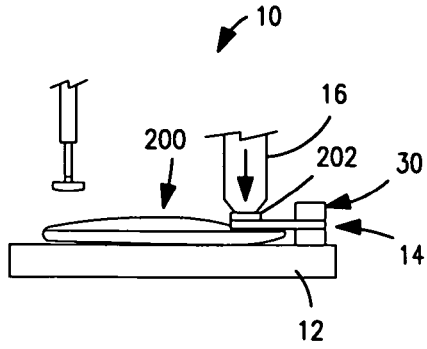
Figure 3C:
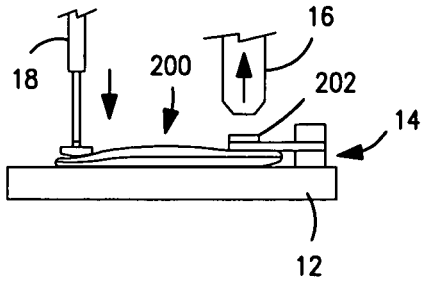
Figure 3E:
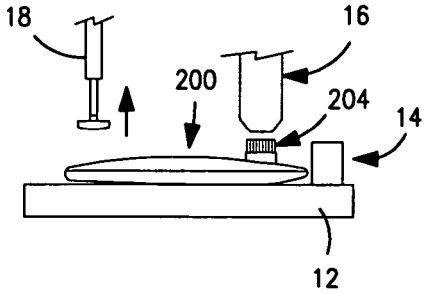
Figure 4:
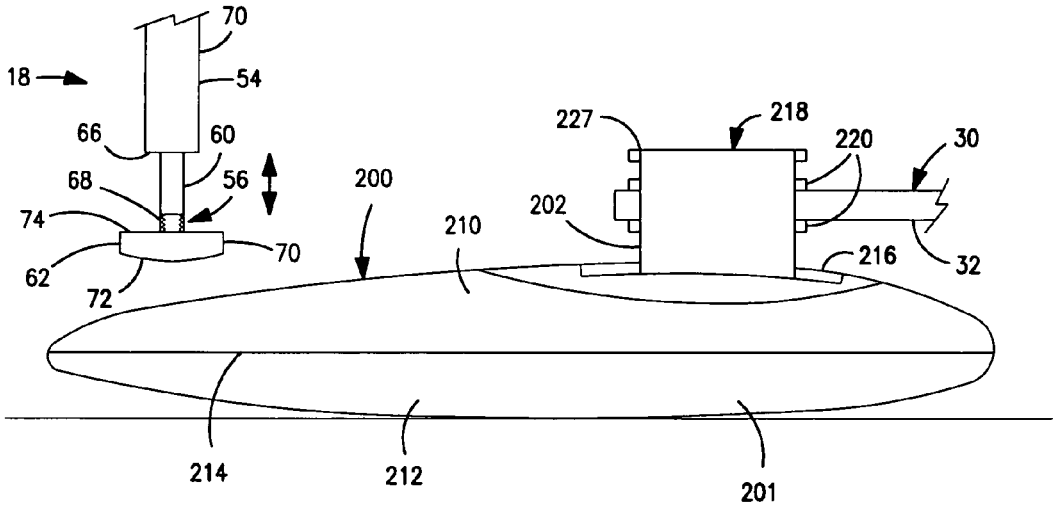
FIG. 4 of the drawings comprises a partial cross-sectional view of the flexible bag showing residual air prior to evacuation.
Figure 5:
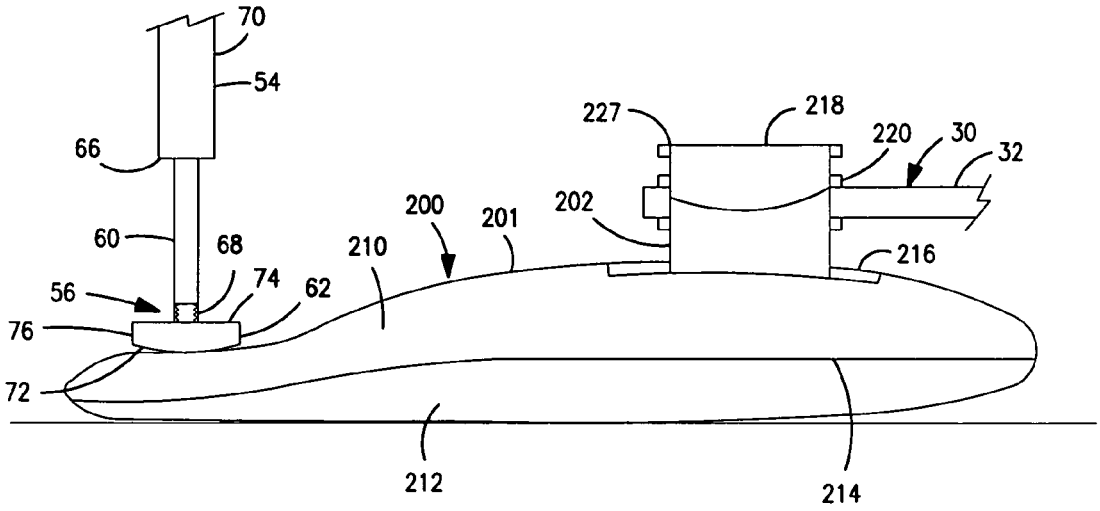
FIG. 5 of the drawings comprises a partial cross-sectional view of the flexible bag showing removal of the residual air by the evacuation facilitating assembly prior to capping.

With reference to FIGS. 4 and 5, spout 202 of flexible bag 200 includes base flange 216, outward outlet passage 218, and gripping flanges 220. Base flange 216 is generally sealed to an opening in flexible bag body 201. As will be explained, gripping flanges 220 extend about the outside of outward outlet passage 218 and facilitate the retention and manipulation of the flexible bag by outside equipment (such as gripper arms and the like). Outward outlet passage 218 terminates at distal end 227. Typically, the distal end 227 is covered by a cap, such as cap 224 (FIG. 3*e*). The cap can be twisted onto the spout or can be pressed onto the spout, depending on the desired application.

Referring again to FIG. 1, the filler device 10 is shown as comprising table 12, container gripper assembly 14, fill valve 16 and evacuation facilitating assembly 18. In certain embodiments additional features, such as, for example, extended shelf life equipment, aseptic sanitizing equipment, among other equipment may be incorporated into the filler device. Furthermore, it will be understood that the filler device shown may comprise a single station. In other embodiments, the filler device may comprise a rotary filler or a linear filler having several stations each of which has a table, container gripper assembly, fill valve and evacuation facilitating assembly. Examples of such fillers include the filler device shown in U.S. Pat. No. 6,305,437 issued to Edwards et al, assigned to the assignee of the present invention. The entire specification of that patent is incorporated by reference.

Table 12 is shown in FIG. 1 as comprising top surface 20 and bottom surface 22. The table may comprise a single integrated member. In certain embodiments the table may comprise a plurality of rollers that are positioned substantially in a plane and surrounded by a frame. In other embodiments, such as the table shown in FIG. 1, table 12 may comprise a plurality of members 21*a*-21*d* which are hinged about their respective periphery so as to open by rotating in a downward direction about the hinges. Typically, such tables are termed bomb-bay type tables. In certain embodiments, the tables may be stationary whereas in other embodiments, the tables may translate or rotate about a predetermined axis. Indeed, a number of different tables are contemplated for use.

Container gripper assembly 14 is shown in FIG. 1 as comprising gripper arm assembly 30 and cap handling assembly 36. Gripper arm assembly 30 includes gripper arms 32 and means 34 for manipulating the gripper arms. In the embodiment shown, the gripper arms comprise two arms which can be manipulated so as to retain a spout therebetween. Typically, and as is shown in FIGS. 4 and 5 the gripper arms 32 grasp the outward outlet passage 218 between one of the flanges 220 positioned therealong. One such gripper arm assembly is shown in U.S. Pat. No. 6,655,109 issued to Resterhouse et al and U.S. Pat. No. 6,889,482 issued to Resterhouse et al, both of which are assigned to the assignee of the present invention. The entire specification of these patents is incorporated by reference herein. Of course, other container gripper assemblies are contemplated for use, such as, for example, horizontal plates which include voids which, shape matingly engage the outward outlet passage of the spout.

Cap handling assembly 36 includes a cap gripping arms 38 and manipulating means 39. The cap handling assembly is configured to remove a cap prior to filling and for replacing the cap after filling. In certain embodiments, the uncapping may be done by a first sub-assembly, and the recapping may be done by a second sub-assembly. Typically, in such a configuration, a first cap is removed and discarded. The container is recapped with a second, new cap. One such cap gripper assembly is shown in the above identified U.S. Pat. No. 6,665,109.

Fill valve 16 is shown in FIG. 1 as comprising fill body 40 and fill valve outlet 42. It will be understood that either the container gripper assembly or the fill body can be translated relative to the other (or both can be translated), so as to place the flexible bag and the fill valve in a position to fill the flexible bag through the spout. The fill valve outlet can be controlled so as to selectively dispense a flowable material therethrough. A number of different embodiments for the fill valve are contemplated, and, indeed the assignee of the present invention manufactures and deploys a number of different fill valves.

Figure 2:
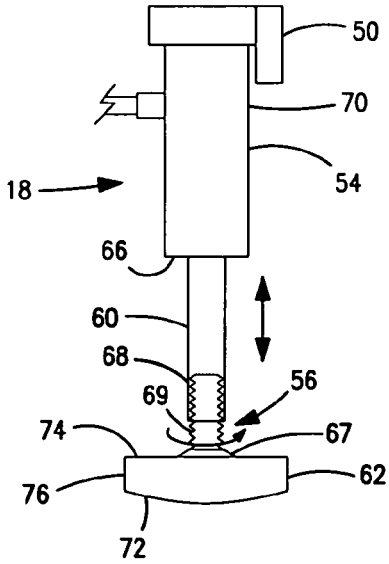
FIG. 2 of the drawings comprises a schematic side elevational view of an evacuation facilitating assembly of the present invention.

Evacuation facilitating assembly 18 is shown generally in FIG. 1, and in detail in FIG. 2, as comprising frame 50, leg member 52, means 54 for displacing the leg member relative to the frame and means 56 for adjusting the displacement of the leg member relative to the frame. Frame 50 is generally coupled to the filler device frame or a portion. In certain embodiments, frame 50 can be coupled to the table, whereas in other embodiments it is attached to another component of the filler device. Typically the frame is spaced apart from the container gripper assembly and the fill valve so as to minimize any interaction therewith. In the embodiment shown, the frame is positioned such that the leg member contacts the flexible bag on the end opposite the spout.

Leg member 52 is shown in FIG. 2 as comprising stem 60 and plate 62. Stem 60 includes a first end 66 and a second end 68 spaced apart from the first end. Plate 62 is attached to the second end of the stem. Preferably stem 60 comprises a substantially elongated rod-like member having a substantially uniform cross-sectional configuration. Plate 62 comprises a substantially planar member having outer surface 72, inner surface 74 and peripheral geometry 76. The peripheral geometry may be any one of rectangular, square, circular or arbitrary, among others. In certain embodiments, the plate may be slightly outwardly convex so as to maintain the outer perimeter from contacting the flexible bag prior to a portion of the outer surface spaced apart from the outer perimeter. Such a configuration minimizes the possibility that the outer perimeter of the plate may snag a portion of the flexible bag.

Displacing means 54 comprises an air cylinder 70 which moves stem 60 from a first position, wherein second end 68 of stem 60 is spaced apart from table 12 to a second position wherein second end 68 of stem 60 is directed towards table 12. In the embodiment shown, the air cylinder is activated by compressed air which is supplied to the filler device. In other embodiments, the displacing means may comprise a solenoid which is configured to move the stem between the desired positions. In still other embodiments, the displacing means may comprise a servo-motor or other electrically controlled motor. In yet another embodiment, the displacing means may comprise a cam actuated assembly, or other mechanically configured system, which moves the stem in the desired manner. Certainly, the invention is not limited to air cylinders and the like.

In another embodiment, adjusting means 56 may comprise a plate (not shown) having slot-like opening therethrough. The displacing means 54 may include mounting screws which can be positioned along the slot-like opening so as to facilitate movement of the displacing means relative to the frame. In turn, the first position and the second position can be varied relative to the table.

Adjusting means 56 comprises the adjustment of plate 62 relative to distal end 68 of stem 60. For example, stem 60 may include a threaded inner bore proximate distal end 68; plate 62 may include frame 67 carrying threaded fastener 69 which mates with the threads of the inner bore of the distal end of stem 60. In turn, rotation of threaded fastener 69 (and the plate therewith) translates the fastener along the distal end of the stem. In turn, the effective length of the stem can be varied, and, in turn, the relative movement of the plate relative to the table. Of course, other adjusting means are contemplated for use.

The operation will be discussed with reference to FIGS. 3*a*-3*f* which show the operation sequentially, as well as with reference to FIGS. 4 and 5. In operation, flexible bag 200 is introduced into filler device 10. Typically, the flexible bag is placed on top surface 20 of table 12. Gripper arm assembly 30 grasps and retains spout 202. Next, the cap is removed by cap handling assembly 36. As is shown in FIG. 3*a*, once the cap is removed, the container is ready for filling.

To fill the container the fill valve 16 is introduced to the flexible bag. In particular, the fill valve body lowered to spout 202 to place fill valve outlet 42 in communication with the outward outlet of the spout (FIG. 3*b*). In other fillers, the gripper arm assembly raises the spout to place it in fluid communication with the fill valve outlet. Once properly positioned, the fill valve outlet releases the flowable material into the flexible bag.

Typically, the flowable material can be metered quite precisely so as to fill the flexible bag to a desired volume or a desired weight. Once properly filled, a quantity of air is introduced into, or an otherwise is present, in the flexible bag. To remove this air from the flexible bag, the evacuation facilitating assembly 18 is employed.

Specifically, and with reference to FIG. 3, the evacuation facilitating assembly is used to reduce the volume of the flexible bag so as to drive the flowable material toward the spout, which flowable material forces the air out of the flexible bag through the spout. Initially, plate 62 is spaced apart from the flexible bag and the table (FIGS. 3*b* and 4). The displacing means 54 is activated directing leg 52 toward the table and the flexible bag. Eventually, plate 62 is forced into the flexible bag and presses the flexible bag against the table essentially sandwich the flexible bag there between (FIGS. 3*c* and 5). The squeezing of the flexible bag into the table reduces the volume of the flexible bag, forcing the flowable material toward the spout, and, in turn, air out of the flexible bag. The adjusting means 56 can be utilized so as to adjust the evacuation facilitating assembly so that the displacing of the leg member forces the flowable material far enough into the spout (without spilling the flowable material), to force virtually all of the air that was present in the filled flexible bag.

Figure 3D:
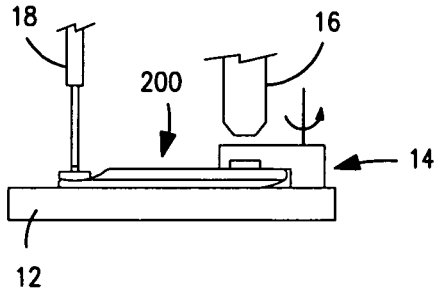
Figure 3F:
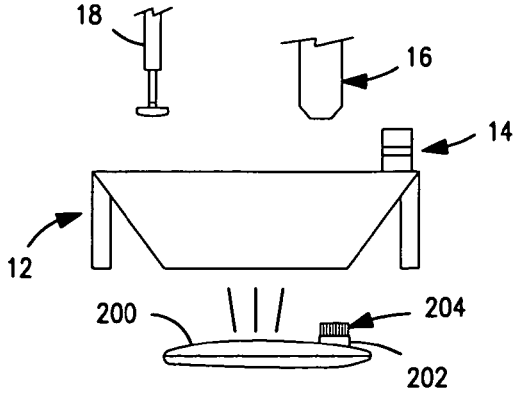

Next, the cap handling assembly is again activated (FIG. 3*d*). The cap handling assembly returns the cap to a position proximate the spout and reattaches the cap to the spout. At such time, the flexible bag is filled and the air has been withdrawn. The displacing means returns the leg member toward its original position, wherein it is spaced away from the flexible bag (FIG. 3*e*). The flexible bag, filled with the flowable material, can then be released from gripper arm assembly, and removed from the filler device (FIG. 3*f*). In as much as the flexible bags are relatively identical and the flowable material can be precisely metered. The assembly need only be adjusted once with the first container to be filled.

Advantageously, as the evacuation facilitating assembly is spaced apart from the table, and generally positioned above the table, a number of different tables can be utilized in conjunction with the evacuation facilitating assembly, including tables that may rotate in a downward direction. Moreover, the evacuation facilitating assembly can be fine tuned for differently sized containers quite easily, thereby facilitating the use of the same evacuation facilitating assembly with a range of differently sized flexible bags which can be filled on a single filler device.

The foregoing description merely explains and illustrates the invention and the invention is not limited thereto except in so far as the appended claims are so limited, as those skilled in the art who have the disclosure before them will be able to make modifications without departing from the scope of the invention.

What is claimed is:

1. A filler device for filling flexible bags comprising:

a table having a top surface configured for receipt of a flexible bag;

a container gripper assembly configured for receipt of a spout of a flexible bag positioned on the table;

a fill valve disposed above the top surface of the table and positionable in fluid communication with the flexible bag; and an evacuation facilitating assembly comprising, a frame spaced apart from the table;

a leg member associated with the frame and positioned above the top surface of the table, spaced apart from the fill valve; and means for displacing the leg member relative to the frame to, in turn, direct the leg member between a first position wherein the leg member is spaced apart from the top surface of the table to a second position wherein the flexible bag is sandwiched between the leg member and the top surface of the table.

2. The filler device of claim 1 wherein the leg member comprises:

a stem having a first end and a second end, the first end associated with the frame; and a plate associated with the second end of the stem.

3. The filler device of claim 2 wherein the plate includes an inner surface and an outer surface and an outer periphery and wherein the outer surface is outwardly convex.

4. The filler device of claim 3 wherein the outer periphery comprises a substantially circular geometric configuration.

5. The filler device of claim 1 wherein the displacing means comprises an air cylinder.

6. The filler device of claim 1 wherein the displacing means comprises one of the group consisting of: air cylinder, mechanically coupled assembly and servo motors.

7. The filler device of claim 1 further comprising means for adjusting the movement of the leg member relative to the frame.

8. The filler device of claim 1 wherein the adjusting means comprises:

a threadform positioned on the second end of the stem of the leg member; and a fastener having a mating threadform coupled to the plate, wherein rotative movement of the fastener translates the fastener, and in turn, the plate along the threadform of the stem.

9. The filler device of claim 1 wherein the frame is positioned above the upper surface of the table.

10. The filler device of claim 1 wherein the table comprises a bomb-bay table.

11. The filler device of claim 1 wherein the leg member is spaced apart from the container gripper assembly and the fill valve.

12. A method of displacing air within a flexible bag upon filling thereof with a flowable material, comprising the steps of:

positioning a flexible bag having a spout on a table;

filling the flexible bag through the spout with a flowable material;

forcing a leg member positioned above the table toward the table and into the flexible bag in a region that is spaced apart from the spout thereof, to, in turn, sandwich the flexible bag between the leg member and the table, so as to reduce the volume of the flexible bag thereby removing at least a portion of any air remaining in the filled flexible bag through the spout.

13. The method of claim 12 further comprising the step of adjusting the travel of the leg member to control the reduction of the volume of the flexible bag.

14. The method of claim 12 further comprising the steps of:

grasping the spout; and removing a cap from the spout prior to the step of filling.

15. A filler device for filling flexible bags comprising:

a table having a top surface configured for receipt of a flexible bag;

a container gripper assembly configured for receipt of a spout of a flexible bag positioned on the table;

a cap handling assembly positioned proximate the container gripper assembly;

a fill valve disposed above the top surface of the table and positionable in fluid communication with the flexible bag; and an evacuation facilitating assembly comprising, a frame positioned above the table;

a leg member movably coupled to the frame and positioned above the top surface of the table, spaced apart from the fill valve; and means for displacing the leg member relative to the frame to, in turn, direct the leg member between a first position wherein the leg member is spaced apart from the top surface of the table to a second position wherein the flexible bag is sandwiched between the leg member and the top surface of the table.

16. The filler device of claim 15 further comprising means for adjusting the displacing means.

* * * * *